US012486069B2

(12) United States Patent
Gilmore

(10) Patent No.: US 12,486,069 B2
(45) Date of Patent: Dec. 2, 2025

(54) CONDIMENT PACKAGING

(71) Applicant: Tamaripak, LLC, Columbus, OH (US)

(72) Inventor: Ryan Gilmore, Columbus, OH (US)

(73) Assignee: Tamaripak, LLC, Columbus, OH (US)

( * ) Notice: Subject to any disclaimer, the term of this patent is extended or adjusted under 35 U.S.C. 154(b) by 3 days.

(21) Appl. No.: 18/144,597

(22) Filed: May 8, 2023

(65) Prior Publication Data

US 2024/0239547 A1 Jul. 18, 2024

Related U.S. Application Data

(60) Provisional application No. 63/439,206, filed on Jan. 16, 2023.

(51) Int. Cl.

| | |
|---|---|
| ***B65D 1/36*** | (2006.01) |
| ***B65D 25/20*** | (2006.01) |
| ***B65D 43/02*** | (2006.01) |
| ***B65D 77/20*** | (2006.01) |

(52) U.S. Cl.

CPC ..... *B65D 1/36* (2013.01); *B65D 25/20* (2013.01); *B65D 43/0202* (2013.01); *B65D 77/20* (2013.01); *B65D 2543/00194* (2013.01)

(58) Field of Classification Search

CPC ..... B65D 1/36; B65D 85/72; B65D 25/20; B65D 43/0202; B65D 77/20; B65D 2543/00194

USPC ..... 206/541, 219

See application file for complete search history.

(56) References Cited

U.S. PATENT DOCUMENTS

| | | | | |
|---|---|---|---|---|
| 2,705,579 | A * | 4/1955 | Mason | B65D 75/327 222/572 |
| 3,917,116 | A * | 11/1975 | Mason | A45D 37/00 222/541.9 |
| 5,263,609 | A * | 11/1993 | Hoshino | B65D 75/58 222/541.3 |
| 5,277,920 | A * | 1/1994 | Weaver, Jr. | B65D 81/3294 222/541.6 |
| 6,003,673 | A * | 12/1999 | Vieu | B65D 81/3294 206/564 |
| 6,708,735 | B1 * | 3/2004 | Kenihan | B65D 51/2842 206/217 |
| 7,325,703 | B2 * | 2/2008 | Gherdan | A61J 1/035 222/541.9 |
| 8,231,026 | B2 * | 7/2012 | White | B65D 43/02 220/23.88 |

(Continued)

*Primary Examiner* — Steven A. Reynolds

(74) *Attorney, Agent, or Firm* — Standley Law Group LLP; Jeffrey S. Standley; Kenny W. Pung

(57) ABSTRACT

Exemplary embodiments described herein are directed to condiment packaging. The condiment packaging includes a first condiment receptacle having a hollow area for receiving a first condiment. The receptacle may be used as a food dipping dish and may be sealed by a removable lid adapted to fit over the receptacle. The condiment packaging also includes a second condiment reservoir attached to the receptacle that has a hollow area for a second condiment. The reservoir may be sealed by a removable tab adapted to fit over the reservoir. Also disclosed are embodiments of the condiment packaging that have eating utensils attached to the exterior surface of the receptacle or lid. The condiment packaging may be useful for containing and distributing of many types of condiments but may be particularly useful for sushi condiments such as soy sauce and wasabi.

5 Claims, 8 Drawing Sheets

(56) References Cited

U.S. PATENT DOCUMENTS

| | | | | |
|---|---|---|---|---|
| D686,090 | S * | 7/2013 | Logue | D9/732 |
| 8,689,972 | B2 * | 4/2014 | Sanchez | B65D 75/5866 222/541.6 |
| 10,059,498 | B2 * | 8/2018 | Barton | B65D 75/326 |
| 2004/0164076 | A1 * | 8/2004 | Baker | B65D 1/30 220/839 |
| 2005/0161471 | A1 * | 7/2005 | Grenda | B65D 1/36 222/94 |
| 2006/0283747 | A1 * | 12/2006 | Lam | B65D 75/30 206/459.1 |
| 2006/0283761 | A1 * | 12/2006 | Gherdan | B65D 81/3261 206/532 |
| 2008/0207754 | A1 * | 8/2008 | Zicker | B65D 75/58 220/500 |
| 2010/0086239 | A1 * | 4/2010 | Latour | B65D 31/12 383/38 |
| 2010/0270330 | A1 * | 10/2010 | Caldwell | B65D 21/0202 222/541.9 |
| 2013/0140209 | A1 * | 6/2013 | Kim | B65D 43/06 220/780 |
| 2013/0236128 | A1 * | 9/2013 | Bray | B65D 31/02 383/69 |
| 2015/0090740 | A1 * | 4/2015 | Barton | B65D 77/283 222/211 |
| 2022/0265072 | A1 * | 8/2022 | Benjamin | A47G 19/04 |

* cited by examiner

CONDIMENT PACKAGING

CROSS-REFERENCE TO RELATED APPLICATIONS

This non-provisional application claims priority to provisional patent application Ser. No. 63/439,206 filed Jan. 16, 2023, the disclosure of which is hereby incorporated by reference as if fully restated herein.

FIELD

The application relates to the field of condiment packaging and, more particularly, to single serving condiment packaging having multiple receptacles, of which at least one of the receptacles is sized to be useful as a sushi dipping dish.

BACKGROUND AND SUMMARY OF THE INVENTION

Many restaurants and food service establishments provide complimentary condiment packets to their customers. Today, most of these condiment packets are in the form of a pouch formed by joining two rectangular pieces of material along their peripheries and filling the interior space defined between them with a condiment. A user of such a packet can tear open the packet along its peripheral edges to create a hole in the pouch. The pouch can then be squeezed or tipped to dispense the condiment.

As those skilled in the art will appreciate, these condiment packets typically leave much to be desired. For one, they require a serving dish or some sort of surface to be dispensed onto. However, this may not always be practical if there are no serving dishes around or if the person is in a place where using a serving dish is not feasible (e.g., take-out orders eaten in a car). Moreover, the act of tearing open a pouch and dispensing condiment out of the pouch can sometimes result in unintentional spills or messes. Accordingly, those skilled in the art continue with research and development efforts in the field of condiment packaging.

DETAILED DESCRIPTION

Figure 1:
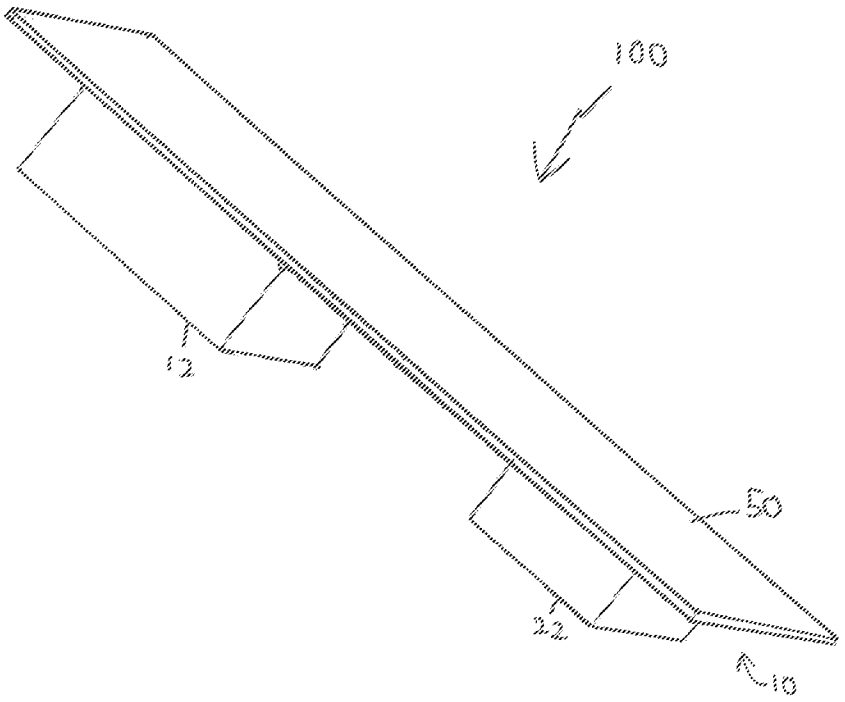
FIG. 1 is a top left-side perspective view of a first exemplary embodiment of a condiment packaging.
Figure 2:
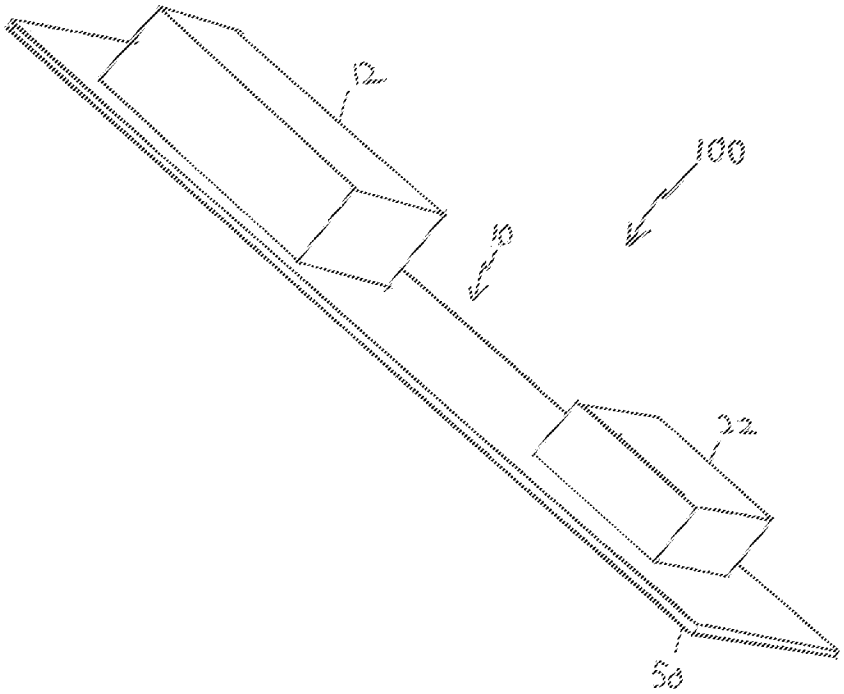
FIG. 2 is a bottom left-side perspective view of the condiment packaging of FIG. 1.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according to the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

The present disclosure relates to a condiment packaging for relatively small amounts of condiments (e.g., single servings). In preferred embodiments, the condiment packaging can be designed to contain multiple condiments in separate compartments that, in turn, can double as serving dishes for those condiments. It is contemplated that this dual-purpose nature means that the condiment packaging is ideal for distributing different types of condiments that are often consumed together (e.g., soy sauce and wasabi, salt and sesame oil, ketchup and mustard, etc.) and particularly in instances where serving dishes are not readily available or otherwise impractical to use (e.g., take-out orders).

Referring to FIGS. 1-5, the present disclosure provides a first exemplary embodiment of the condiment packaging 100. Condiment packaging 100 includes a main body 10 and a peelable top 50. The main body 10 includes a planar portion 30 that defines an upper major side 32 and a lower major side 34; and further includes a first recessed portion 12 and a second recessed portion 22. The first and second recessed portions 12, 22 are generally disposed centrally about the planar portion 30 (i.e., not near the periphery) and extend below its lower major side 34. The result of this design is that there are upper-side recesses 14, 24 defined by the recessed portions 12, 22 which may each be filled with a quantity of condiment. Then, the peelable top 50 may be applied to the upper major side 32 of the planar portion 30 to seal close the recesses 14, 24, in a manner known to those of ordinary skill in the art. When the peelable top 50 is applied, the peelable top 50 and the recesses 14, 24 collectively define compartments 18, 28 in the condiment packaging 100. Peeling off the peelable top 50 opens these compartments 18, 28 and makes the condiments contained therein accessible once again. Notably, the openings 16, 26 to the recesses 14, 24 are relatively wide open (as compared to conventional pouch-type condiment packets). This enables the dipping or dunking of food items into the recesses 14, 24 as if the main body 10 were a serving dish.

Figure 5:
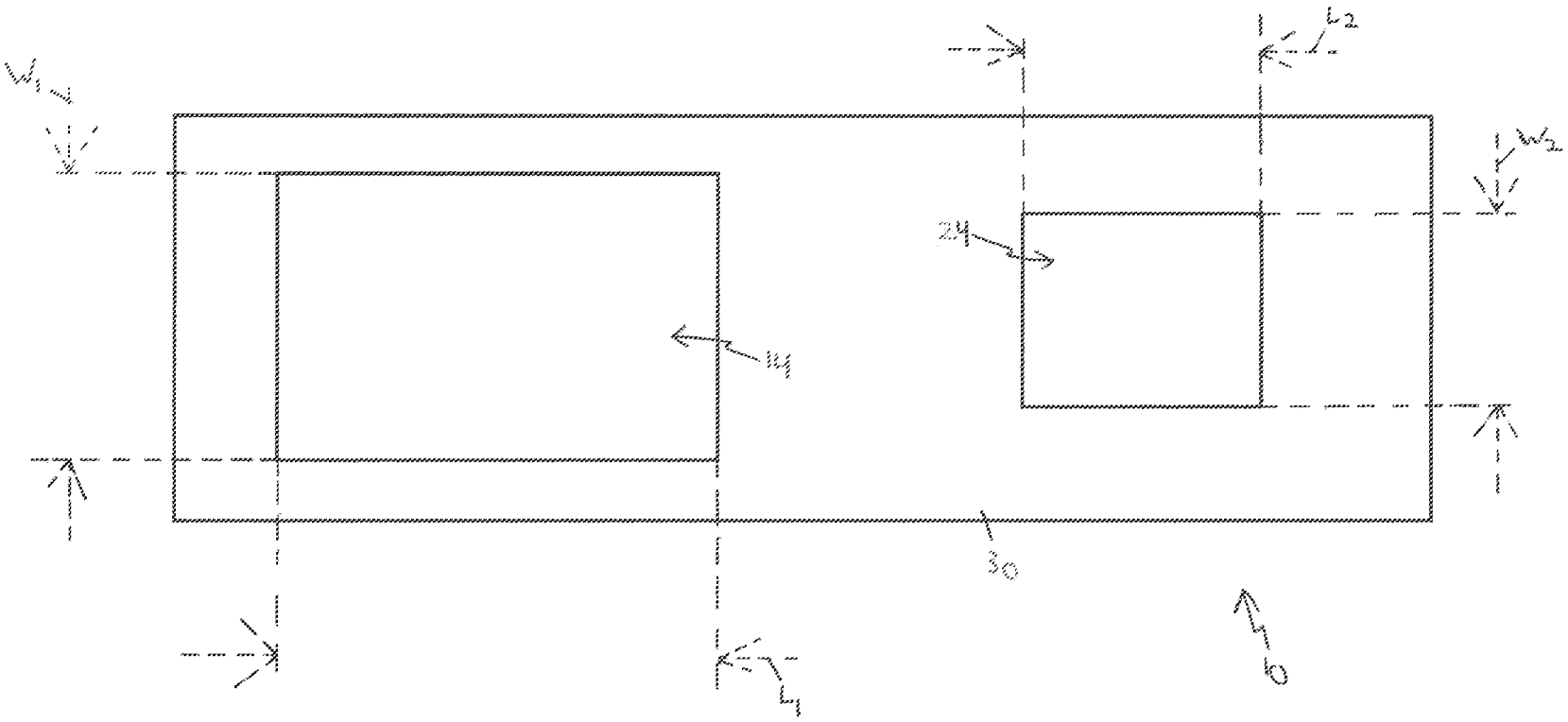
FIG. 5 is a top plan view of the main body of the condiment packaging of FIG. 1.

As shown, the first and second recessed portions 12, 22 are generally square or rectangular in shape (i.e., when viewed from the top, as seen in FIG. 5). As a result of this design, the compartments are generally polyhedral (more accurately, hexahedral) in shape.

In other embodiments, it is contemplated that the shape of the compartments may vary without departing from the scope of the present disclosure. For example, compartments may be fabricated in different polyhedral shapes, or in non-polyhedral shapes (i.e., rounded or circular compartments), or even in irregular shapes. It is also contemplated that the various compartments of any given embodiment of the condiment packaging do not need to match or be otherwise similar in shape. The shape of these compartments can vary as desired on an individual basis.

Still referring to FIGS. 1-5, the first compartment 12, in one example embodiment, is larger than the second compartment 22. It is larger in length L, width W, and depth D. In other embodiments, however, it is contemplated that any given physical dimension of the compartments may be varied as needed or desired without departing from the scope of the present disclosure (including being uniform in size if the compartments are the same shape).

It is contemplated that the condiment packaging of the first embodiment 100 may be particularly well suited for containing soy sauce and wasabi. Since most sushi eaters typically consume a larger amount of soy sauce than wasabi, the larger first compartment 12 may contain a quantity of soy sauce and the smaller second compartment 22 may contain a quantity of wasabi. Preferably, the first compartment 12 may have: a length $L_1$ ranging from about 1.25 inches to about 2.5 inches, or more preferably about 2 inches, in order to accommodate a piece of sushi to be dipped into compartment 12 during use; a width $W_1$ ranging from about 1.25 inches to about 1.75 inches, or more preferably about 1.5 inches; and a depth $D_1$ ranging from about 0.75 inch to about 1.25 inches, or more preferably about 1 inch. Ideally, a first compartment of this size would be able to contain approximately one-half ounce of soy sauce. Moreover, a first compartment of this size would also be large enough to accommodate a piece of sushi being dipped into it, meaning that it may double as a serving dish. Preferably, the second compartment 22 may be smaller than the first compartment and have: a length $L_2$ ranging from about ½ inch to about 1 inch, or more preferably about 0.75 inch; a width $W_2$ ranging from about ½ inch to about 1 inch, or more preferably about 0.75 inch; and a depth $D_2$ ranging from about ⅓ inch to about ¾ inch, or more preferably about ½ inch. Ideally, a second compartment of this size would be capable of containing about ½ to 1 teaspoon of wasabi in paste form.

Those skilled in the art (i.e., the single serving condiment packaging art) will be aware of the various ways in which the main body 10 can be fabricated, of which there may be several. Some that may be used, for example, are plastic injection molding, and vacuum forming.

Figure 3:
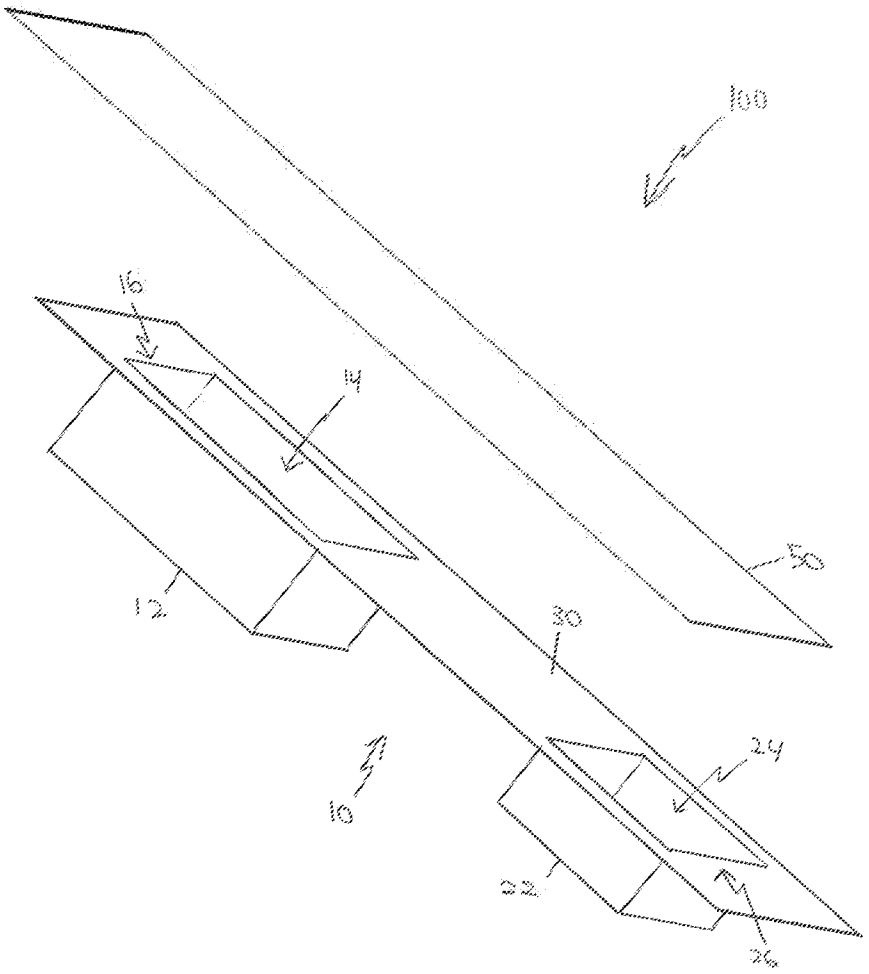
FIG. 3 is an exploded top left-side perspective view of the condiment packaging of FIG. 1.
Figure 4:
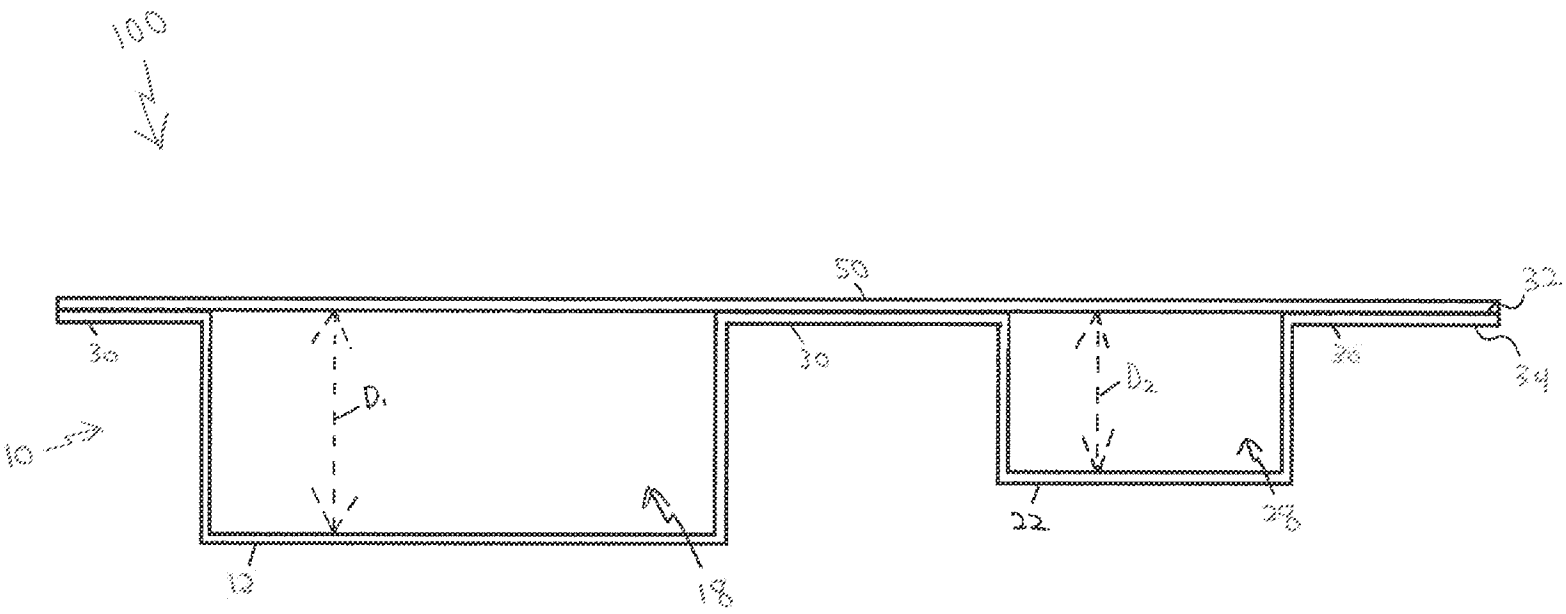
FIG. 4 is a left-side cross-sectional view of the condiment packaging of FIG. 1.

Referring to FIG. 3, the peelable top 50 is a relatively thin piece of material affixed to the upper major side 32 of the planar portion 30. The peelable top 50 may have a material composition that includes, but is not limited to, plastic, metal, or paper. Those skilled in the art will be aware of the various ways in which the peelable top 50 may be applied, the suitability of which may depend (at least in part) on the material composition of the peelable top 50. In any case, the peelable top 50 (regardless of its material composition or how it is applied) should ideally cover the entire opening of a recess (e.g., ref. nos. 16 and 26) to ensure that condiment won't spill out.

Figure 6:
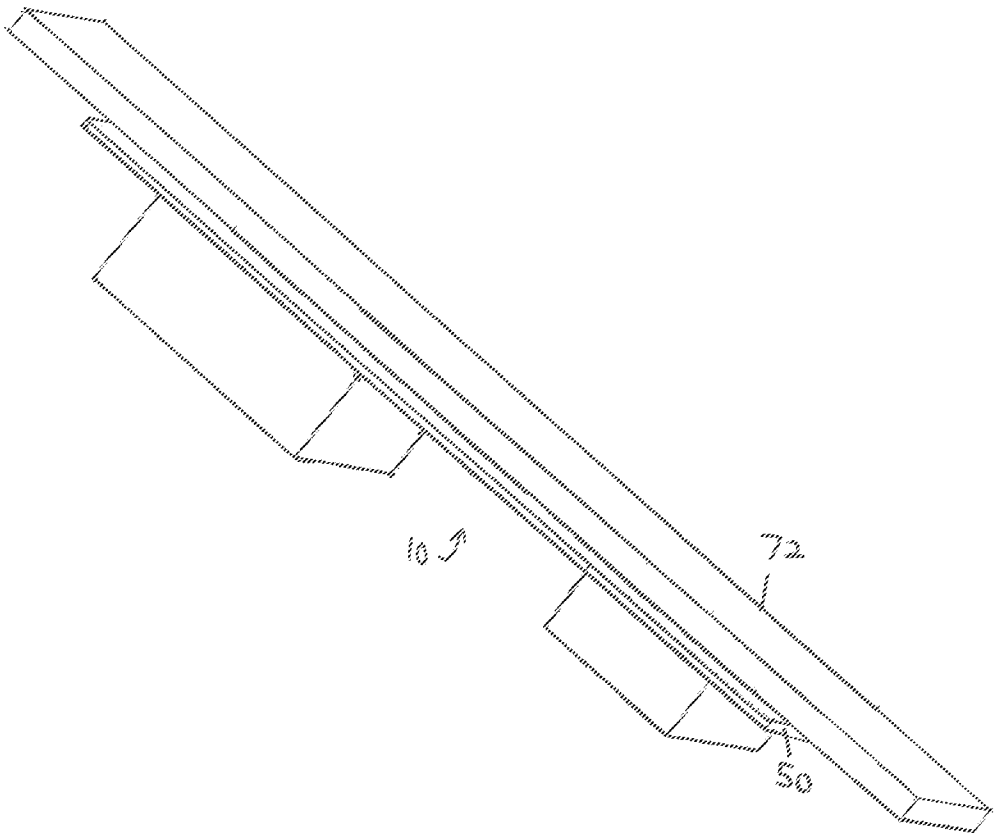
FIG. 6 is a top left-side perspective view of a second exemplary embodiment of a condiment packaging.
Figure 7:
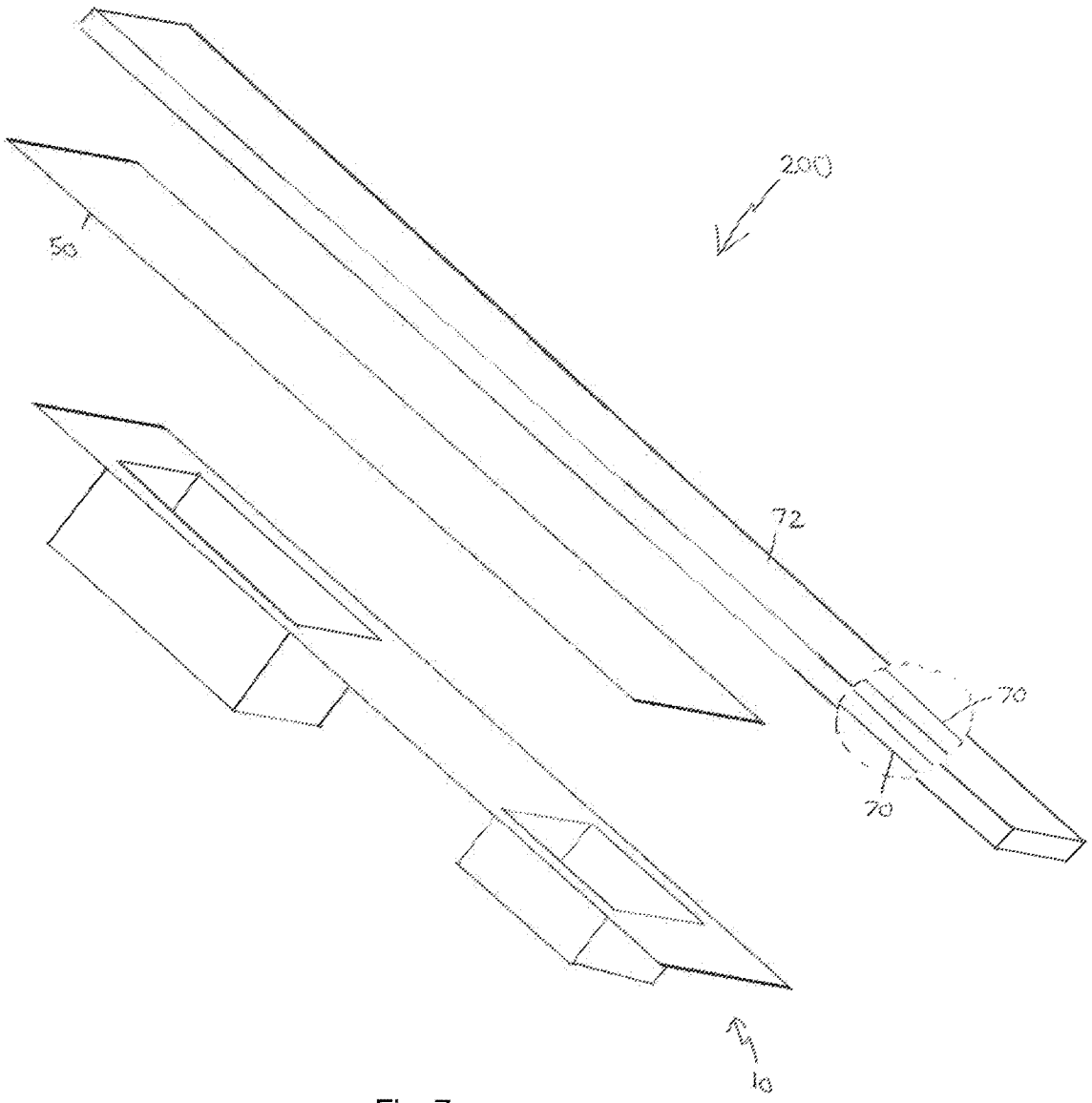
FIG. 7 is an exploded top left-side perspective view of the condiment packaging of FIG. 6.

Referring to FIGS. 6-7, the present disclosure provides a second exemplary embodiment of the condiment packaging 200. This embodiment 200 is similar to the first embodiment 100 except that it further includes one or more eating utensils removably attached to the peelable top 50. The eating utensils in this example embodiment are a pair of chopsticks 70 contained within a sealed wrapper 72, which is included to keep the chopsticks 70 sanitary. The wrapper may have a paper or plastic material composition. The wrapper may be attached to the peelable top by any suitable means—e.g., adhesives.

Figure 8:
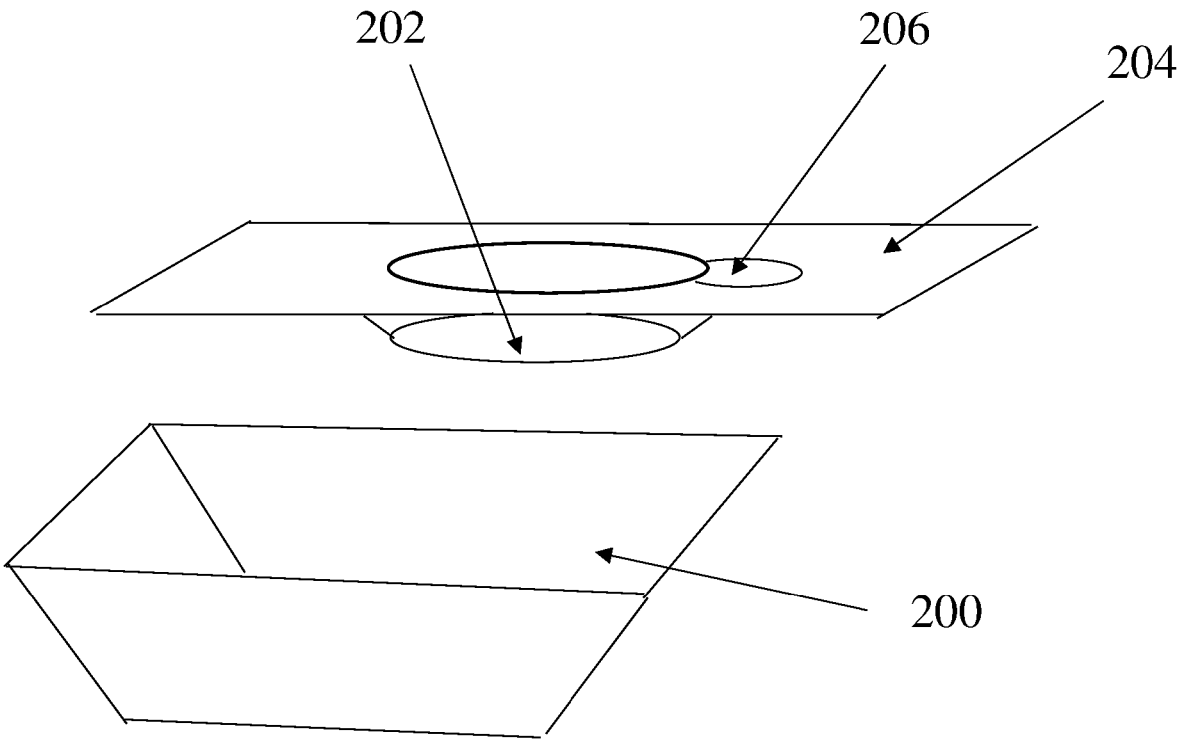
FIG. 8 shows another embodiment of the present invention.

FIG. 8 shows another embodiment of the present invention. In this embodiment the receptacle 201 is covered by the lid 204. A first condiment such as soy sauce may be placed in the hollow open receptacle 201 and the lid 204 is attached thereafter. Within the lid, a holding reservoir 202 may be formed. A desired amount of a second condiment such as wasabi may be placed in the reservoir 202, for later use. A removable tab 206 may be sealed over the open top of the reservoir and onto the lid surface. When use occurs, a user may peel back or otherwise remove the tab to gain access to the second condiment (such as wasabi) in the reservoir 202. Then the user may peel back or otherwise remove the lid 204 to gain access to the first condiment (such as soy sauce) in the receptacle 201. The user may then add a desired amount of the second condiment to the first condiment in the receptacle 201, and use the receptacle 201 as a dish in which to dip sushi or other food items, to eat. In this embodiment, the receptacle 201 is preferably sized and shaped to accommodate the dipping of a standard size piece of Japanese sushi. In this embodiment, the shape of the soy sauce receptacle 201 may be as shown in FIG. 8. The lid and reservoir may be formed as one piece from plastic (such as by injection molding), or by thin film forming, as known to those of skill in the packaging arts. The tab is preferably formed of thin foil, and adhesively (or otherwise) removably bonded to the lid to fully cover the reservoir after the first condiment is placed in the reservoir. The receptacle 201 is preferably made of plastic, such as by injection molding. Once the receptacle 201 is filled with the first condiment to a desired extent, the lid 204 is preferably sealed to the top surface of the receptacle 201. The first and second condiments may be hermetically sealed into the receptacle and reservoir respectively, but hermetically sealing is not required by the present invention.

Other embodiments may vary by having different types of eating utensils attached (e.g., forks, knives, spoons); or by having eating utensils attached at different locations (e.g., along the sides or bottom of the main body rather than the peelable top); or by some combination of these variations. Variations such as these will not amount to a departure from the scope of the present disclosure.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A condiment packaging, comprising:

a condiment receptacle having an upper planar portion and four sidewalls in a rectangular arrangement, that extend downwards, substantially transverse relative to the upper planar portion, defining a hollow area containing about a half ounce of soy sauce and a top-side opening into the hollow area, the top-side opening having an area ranging from about 1.56 $inches^2$ to about 4.38 $inches^2$ and the hollow area having a depth ranging from about 0.75 inches to about 1.25 inches;

a condiment reservoir attached to said receptacle, said reservoir having a hollow area containing wasabi and a top-side opening into the hollow area, the hollow area having a depth that is less than the depth of the hollow area of the condiment receptacle; and at least one peelable top adapted to fit over and seal the openings of said receptacle and said reservoir.

2. The packaging of claim 1, further comprising chopsticks in a protective covering and said covering removably secured to an outside surface of said packaging.

3. The packaging of claim 1, wherein said reservoir is formed as one piece with said lid.

4. The packaging of claim 1, wherein said reservoir is substantially permanently adjoined to and adjacent to said receptacle.

5. The packaging of claim 1, wherein the depth of the hollow area of the condiment reservoir ranges from about 0.33 inches to about 0.5 inches.

* * * * *